US010920428B2

(12) United States Patent
Culpepper et al.

(10) Patent No.: US 10,920,428 B2
(45) Date of Patent: Feb. 16, 2021

(54) SIDING PANEL AND ASSEMBLY TO ADDRESS DIMPLING

(71) Applicant: Progressive Foam Technologies, Inc., Beach City, OH (US)

(72) Inventors: Patrick M. Culpepper, Canton, OH (US); Ryan Beach, New Philadelphia, OH (US)

(73) Assignee: Progressive Foam Technologies, Inc., Beach City, OH (US)

( * ) Notice: Subject to any disclaimer, the term of this patent is extended or adjusted under 35 U.S.C. 154(b) by 0 days.

(21) Appl. No.: 16/400,632

(22) Filed: May 1, 2019

(65) Prior Publication Data

US 2019/0338532 A1 Nov. 7, 2019

Related U.S. Application Data

(60) Provisional application No. 62/665,898, filed on May 2, 2018.

(51) Int. Cl.
*E04F 13/08* (2006.01)

(52) U.S. Cl.
CPC ..... *E04F 13/0864* (2013.01)

(58) Field of Classification Search
CPC ..... E04F 13/0864; E04F 13/0866
See application file for complete search history.

(56) References Cited

U.S. PATENT DOCUMENTS

| | | | | |
|---|---|---|---|---|
| 9,080,081 | B2 * | 7/2015 | Toyoda | C09J 5/00 |
| 2004/0166294 | A1 * | 8/2004 | Dalvey | B41M 5/40 428/195.1 |
| 2018/0202167 | A1 * | 7/2018 | Culpepper | E04F 13/075 |

* cited by examiner

*Primary Examiner* — Jeanette E Chapman
(74) *Attorney, Agent, or Firm* — Fay Sharpe LLP

(57) ABSTRACT

The present disclosure describes composite siding panels with a structure that reduces dimpling. The siding panel comprises a backing member and a siding member that are joined by an adhesive layer. The adhesive layer may be made with fingers extending from its sides, or may be made with an adhesive that has an elongation factor of at least 1000%. These reduce dimpling.

13 Claims, 10 Drawing Sheets

SIDING PANEL AND ASSEMBLY TO ADDRESS DIMPLING

CROSS-REFERENCE TO RELATED APPLICATIONS

This application claims priority to U.S. Provisional Patent Application Ser. No. 62/665,898 filed May 2, 2018, the contents of which are incorporated herein in their entirety.

BACKGROUND

The present disclosure relates to a composite siding panel that can be used on an exterior wall of a building such as a residential home. Methods and processes for making and/or using such siding panels are also disclosed.

In particular, the present disclosure provides for a composite siding panel including a siding member attached to a foam backing member using an adhesive layer. The adhesive layer is configured in a specific manner so as to reduce "dimpling," which can occur due to expansion related to sun exposure. Such a problem is particularly visible on siding panels of dark color.

Composite siding panels are known in the art. Vinyl siding is a popular choice because it is easily cleaned and it is resistant to deterioration. It may also be easily installed around windows and doors. Moreover, it may be produced in a variety of shapes and colors by known extrusion and molding processes at a relatively low cost per sheet or panel.

In many traditional composite siding panels, a vinyl siding member is attached to a foam backing member (a "backer"). An adhesive layer joins the front of the foam backing member to the siding member. In such composite siding panels, a visual defect known as "dimpling" has been identified. It is found to be most visible when the vinyl siding is a dark color, and when the siding panel is viewed at certain angles in bright sunlight and/or under certain temperature conditions. It would be desirable to provide composite siding panels that reduce such dimpling.

BRIEF DESCRIPTION

Disclosed in various embodiments herein are composite siding panels comprising a backing member and a siding member joined together by an adhesive layer. At least two different approaches have been found to reduce dimpling. In one approach, the sides of the adhesive layer are configured in a staggered or sawtooth pattern. In another approach, the adhesive layer is formed from a polyurethane that has an elongation factor of 1000% or more.

In some embodiments disclosed herein, the composite siding panel comprises a backing member, a siding member, and an adhesive layer. The backing member has a front face, a rear face opposite the front face, a first side edge, and a second side edge opposite the first side edge. The siding member has a front face, a rear face opposite the front face, a first side edge, and a second side edge opposite the first side edge. The adhesive layer joins the rear face of the siding member to the front face of the backing member. The adhesive layer comprises a central area having a first side edge and a second side edge, and a set of first fingers extending from the first side edge and spaced apart from each other.

In further embodiments, the adhesive layer also comprises a set of second fingers extending from the second side edge and spaced apart from each other. The first fingers and the second fingers form a staggered or sawtooth pattern on their respective sides of the central area of the adhesive layer.

In some embodiments, the first fingers and the second fingers are staggered relative to each other. In other embodiments, the first fingers and the second fingers are extend from the central area of the adhesive layer at the same height. The intervals between first fingers may be regular. The intervals between second fingers may also be regular.

The first side edge and the second side edge of the adhesive layer may be set back from the first side edge and the second side edge of the backing member by a distance of at least 5 inches. In more particular embodiments, the first side edge and the second side edge of the adhesive layer are set back from the first side edge and the second side edge of the backing member by a distance of 5 inches to 8 inches.

The first fingers and the second fingers may be set back from the first side edge and the second side edge of the backing member by a distance of at least 3.0 inches. The first fingers and the second fingers may have a length of at least 2 inches. The first fingers and the second fingers can more particularly have a length of 2 inches to 4.5 inches.

The first fingers and the second fingers may have a height of 2 inches or less. They may also have a height of at least 1 inch.

The adhesive layer may be made of a polyurethane having an elongation factor of 1000% or greater.

Also disclosed herein are embodiments where the composite siding panel comprises a backing member, a siding member, and an adhesive layer. The backing member has a front face, a rear face opposite the front face, a first side edge, and a second side edge opposite the first side edge. The siding member has a front face, a rear face opposite the front face, a first side edge, and a second side edge opposite the first side edge. The adhesive layer joins the rear face of the siding member to the front face of the backing member. The adhesive layer is made of a polyurethane having an elongation factor of 1000% or greater.

These and other non-limiting characteristics are more particularly described below.

BRIEF DESCRIPTION OF THE DRAWINGS

The following is a brief description of the drawings, which are presented for the purposes of illustrating the exemplary embodiments disclosed herein and not for the purposes of limiting the same.

DETAILED DESCRIPTION

Figure 1:
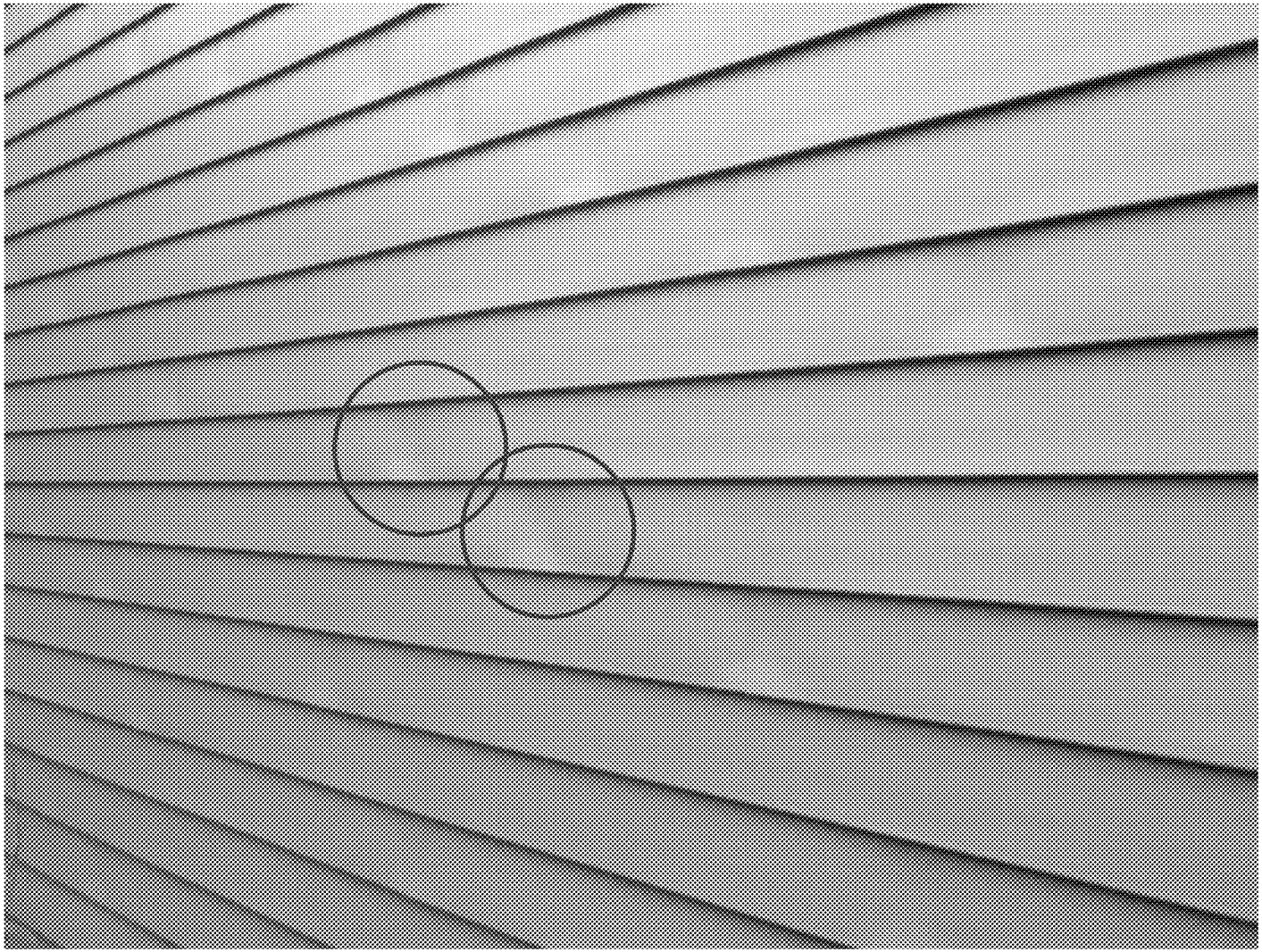
FIG. 1 is a perspective view showing dimples on a conventional composite siding panel.

A more complete understanding of the components, panels, assemblies, and processes disclosed herein can be obtained by reference to the accompanying drawings. These figures are merely schematic representations based on convenience and the ease of demonstrating the present disclosure, and are, therefore, not intended to indicate relative size and dimensions of the devices or components thereof and/or to define or limit the scope of the exemplary embodiments. In the drawings and the following description below, it is to be understood that like numeric designations refer to components of like function.

The present disclosure may be understood more readily by reference to the following detailed description of desired embodiments and the examples included therein. In the following specification and the claims which follow, reference will be made to a number of terms which shall be defined to have the following meanings.

The singular forms "a," "an," and "the" include plural referents unless the context clearly dictates otherwise.

The term "comprising" is used herein as requiring the presence of the named components/steps and allowing the presence of other components/steps. The term "comprising" should be construed to include the term "consisting of", which allows the presence of only the named components/steps, along with any impurities that might result from the manufacture of the named components/steps.

Numerical values should be understood to include numerical values which are the same when reduced to the same number of significant digits and numerical values which differ from the stated value by less than the experimental error of conventional measurement technique of the type described in the present application to determine the value.

All ranges disclosed herein are inclusive of the recited endpoint and independently combinable (for example, the range of "from 2 grams to 10 grams" is inclusive of the endpoints, 2 grams and 10 grams, and all the intermediate values).

The terms "substantially" and "about" can be used to include any numerical value that can vary without changing the basic function of that value. When used with a range, "substantially" and "about" also disclose the range defined by the absolute values of the two endpoints, e.g. "about 2 to about 4" also discloses the range "from 2 to 4." The terms "substantially" and "about" may refer to plus or minus 10% of the indicated number. It is noted that when the term "substantially" is used in the context of describing the location of adhesive relative to edges of the backing member or the siding member, this term refers to +/−one-quarter of an inch (¼ inch).

The present disclosure refers to components as having a length, width, height, and thickness. It is noted that "length" and "width" are used interchangeably herein, or put another way, these terms refer to the same dimension or axis. It is also noted that the components of the present disclosure are three-dimensional, and as a result the terms "edge" and "face" may refer to the same component, depending on the perspective of that component in a given figure or drawing. For example, a face will have two dimensions when viewed head-on, but will appear to be an edge when viewed from the side.

It should be noted that many of the terms used herein are relative terms. For example, the terms "upper" and "lower" are relative to each other in location, i.e. an upper component is located at a higher elevation than a lower component in a given orientation, but these terms can change if the device is flipped. The terms "horizontal" and "vertical" are used to indicate direction relative to an absolute reference, i.e. ground level. The terms "above" and "below", or "upwards" and "downwards" are also relative to an absolute reference; an upwards flow is always against the gravity of the earth.

The term "parallel" should be construed in its lay term as two edges or faces generally continuously having the same distance between them, and should not be strictly construed in mathematical terms as requiring that the two edges or faces cannot intersect when extended for an infinite distance. Similarly, the term "planar" should not be strictly construed as requiring that a given surface be perfectly flat.

Figure 6:
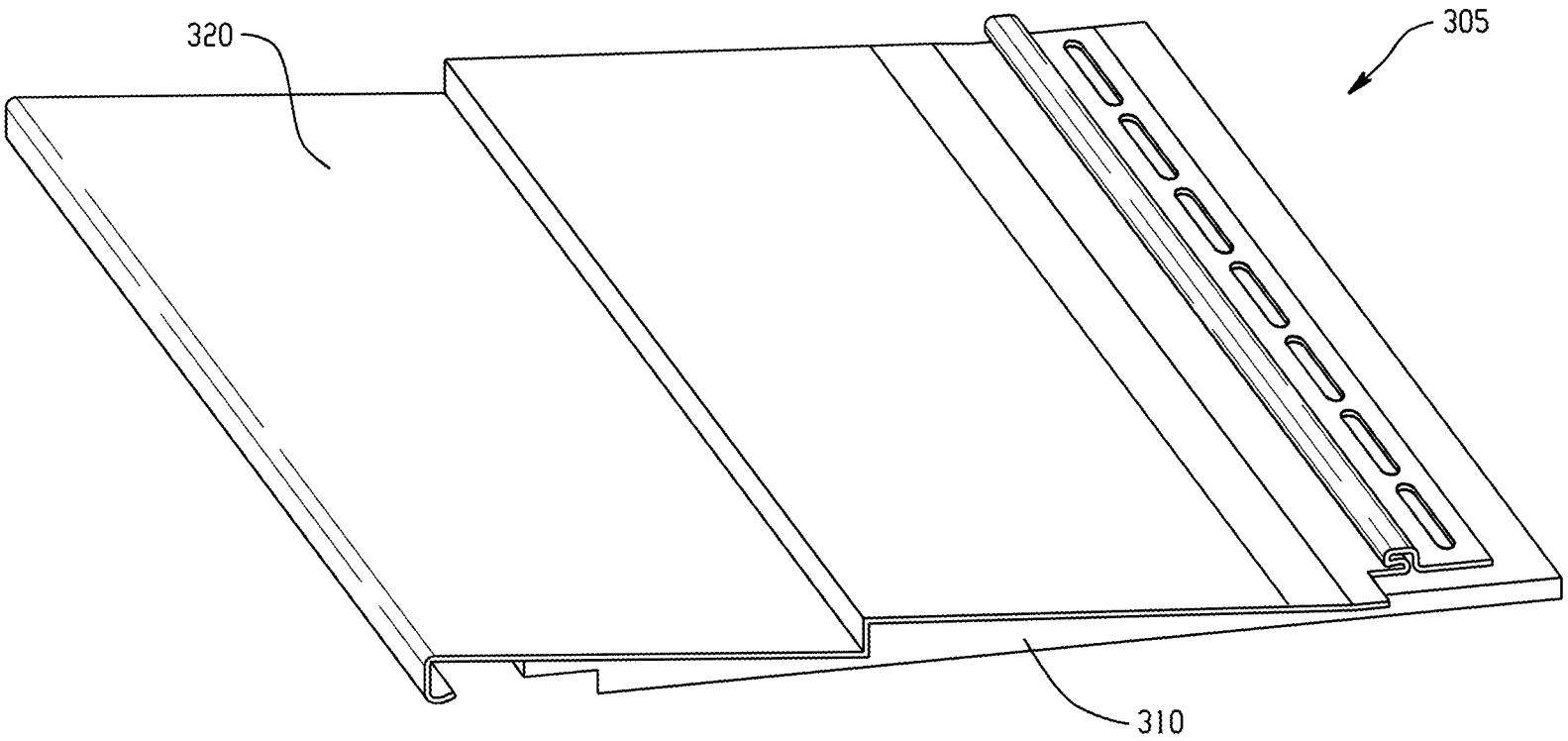
FIG. 6 PRIOR ART
FIG. 6 is a perspective view of a conventional art bidirectional composite siding panel. The conventional composite siding panel includes a siding member and a backing member.
Figure 7:
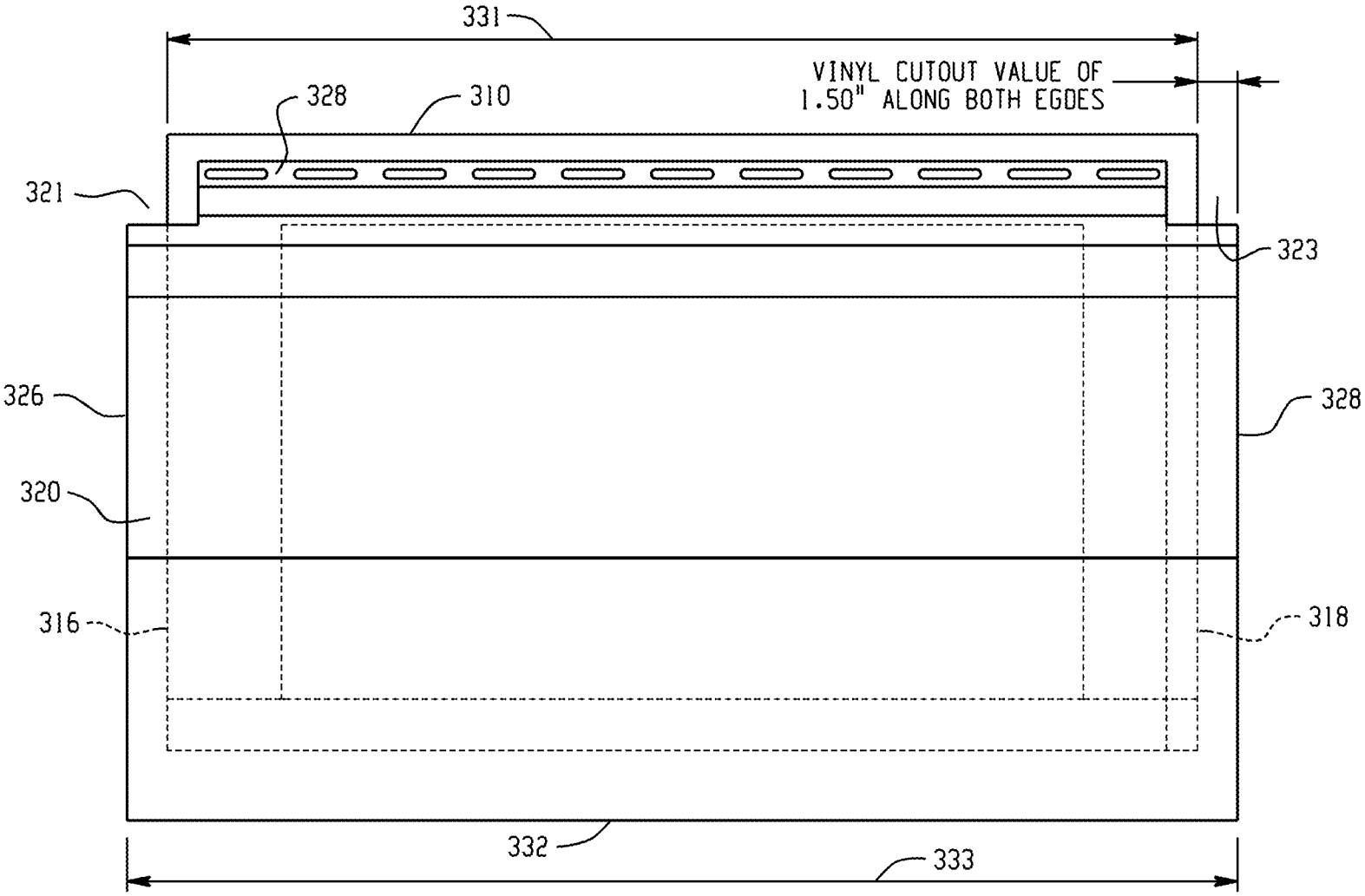
FIG. 7 PRIOR ART
FIG. 7 is a front view of the conventional composite siding panel of FIG. 6, showing some features. The siding member includes vinyl cutouts along both edges of the siding member proximate a top end thereof.
Figure 8:
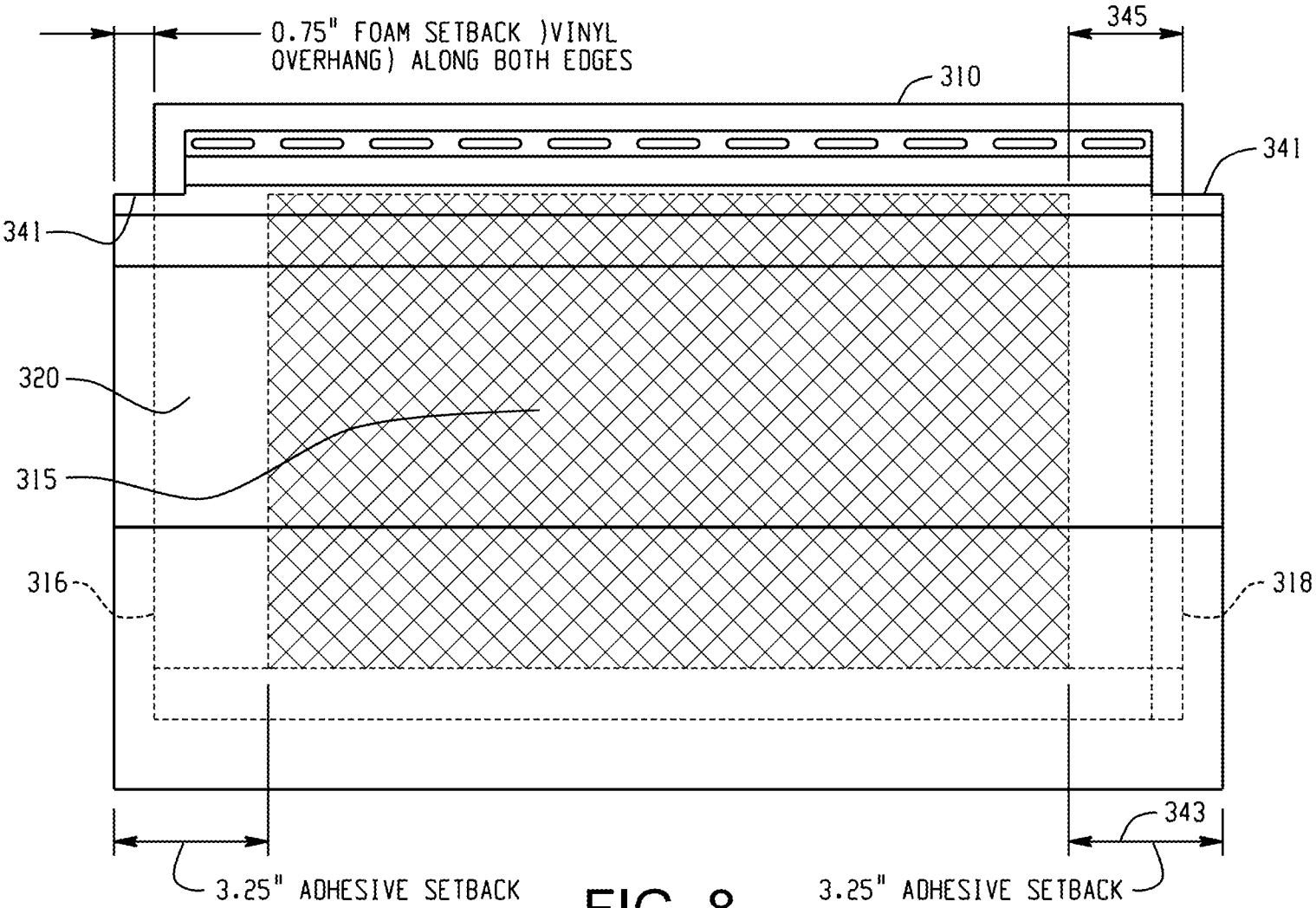
FIG. 8 PRIOR ART
FIG. 8 is a front view of the conventional composite siding panel of FIG. 6, showing different features from that of FIG. 7.
Figure 9:
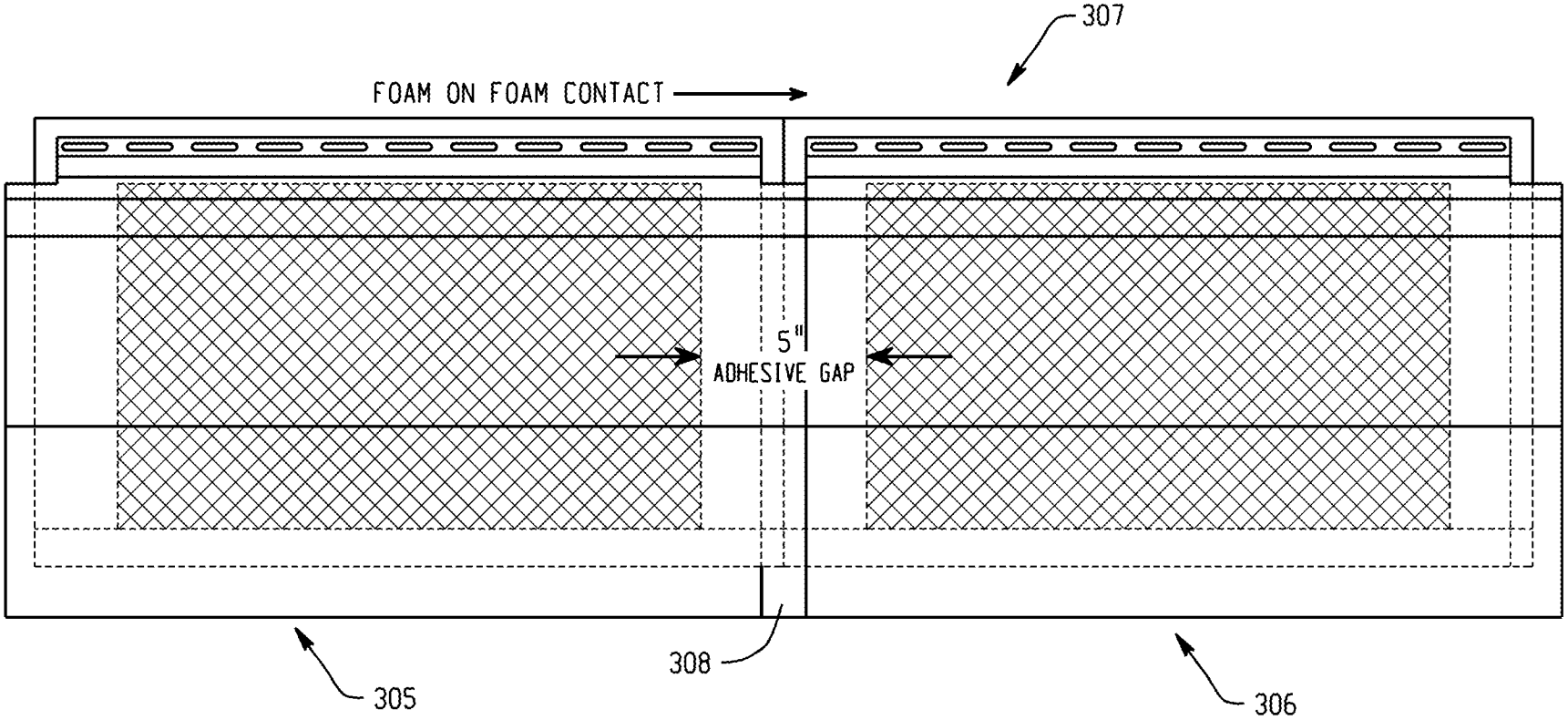
FIG. 9 PRIOR ART
FIG. 9 is a front view of a conventional siding assembly comprising two of the composite siding panels of FIG. 6 placed side-to-side adjacent one another with the backing members abutting one another (i.e., foam on foam contact). Solid lines indicate the perimeters of the siding members, and the outer dashed lines indicate the perimeter of the portions of the backing members behind the siding members. The lighter shaded area and inner dashed lines indicate where the placement of adhesive on the front faces of the backing members starts and stops. The darker shaded area indicates the location of an adhesive gap (where no adhesive is present) between the backing members of the two adjacent siding panels.

The present disclosure relates to composite siding panels that reduce dimpling. For purposes of comparison, FIGS. 6-8 show a conventional composite siding panel. FIG. 9 shows a conventional siding assembly.

FIG. 6 is a perspective view of a prior art composite siding panel 305. The composite siding panel is formed from a backing member 310 and a siding member 320, which are joined together by an adhesive layer (not visible).

FIG. 7 is a front view that shows the placement of the backing member 310 relative to the siding member 320 and the relative placement of the adhesive layer 315 between the two members. Solid lines indicate the perimeter of the siding member. The outer, lighter dashed lines indicate the perimeter of the portions of the backing member behind the siding member. The inner, darker dashed lines indicate where the placement of adhesive on the front face of the backing member starts and stops. The siding member 320 has a first side edge 326 and a second side edge 328 at the opposite side thereof. A nailing hem 330 is present at the top of the siding member 320. However, the length 331 of the nailing hem 330 along the top of the siding member is shorter than the length 333 of the bottom edge 332 of the siding member, with the nailing hem being centered along the top of the siding member 320. Put another way, the siding member 320 has cutouts 321, 323 along both the first and second side edges 326, 328 thereof. The cutouts are defined by how far the first and second side edges 326, 328 of the siding member 20 extend beyond the nailing hem. In this embodiment, each cutout has a length of 1.50 inches.

Continuing, the backing member 310 is located behind the siding member 320, and has a rectangular shape. A first side face 316 of the backing member 310 is spaced apart or away from the first side edge 326 of the siding member 320. A second side face 318 of the backing member 310 is also spaced apart or away from the second side edge 328 of the siding member 320. Put another way, the side edges of the backing member are not aligned with the side edges of the siding member. Rather, the backing member 310 runs from a point short of the first side edge 326 of the siding member 320 to a point short of the second side edge 328 of the siding member 320. This results in a small "overhang" on each side, where the side edge of the siding member extends beyond the backing member. The overhangs are better seen in FIG. 8, and are numbered with reference numerals 341, with each overhang having a length of 0.375 inches to 1.25 inches, with the most common overhang value being 0.75 inches.

An adhesive layer 315 is centrally located on the backing member 310 between the laterally-extending side edges 316, 318 thereof, and is spaced apart from those side edges. The adhesive layer joins the front face of the backing member 310 to the rear face of the siding member 320.

Referring now to FIG. 8, the adhesive layer 315 does not run completely to either of the laterally-extending front side edges of the backing member 310. Instead, the adhesive layer 315 is set back from both the first front side edge 316 of the backing member 310 and the second front side edge 318 of the backing member 310. This creates an adhesive setback 343 from the first and second side edges of the siding member, which is illustrated here with a size of 3.25 inches along both the first and second side edges 326, 328 of the siding member 320 (length indicated with reference numeral 343). There is no adhesive present in this setback, and it can be seen that there is no adhesive present along the first 1.5 inches to 3.5 inches of each side of the front face of the backing member (length indicated with reference numeral 345), with the most common setback being 2.5 inches.

FIG. 9 illustrates a siding assembly 307 comprising two prior art composite siding panels 305, 306. The composite siding panels 305, 306 are placed side-by-side adjacent one another with the backing members abutting one another (i.e., foam on foam contact). As previously mentioned, there is commonly a 2.50 inch adhesive setback on each side of the rear face of the backing member. Thus, there is commonly a 5.00 inch adhesive gap (i.e., a zone in which no adhesive is present) between the backing members of the adjacent siding panels, although this adhesive gap can vary from 3.0 inches to 7.0 inches. The siding panel overhangs overlap each other in the zone with reference numeral 308. It is noted that because the prior art panels are symmetrical with the backing members of each siding panel being centrally located on the siding members thereof, such that each siding panel has two overhangs and two adhesive setbacks, an adhesive gap will be present between two siding panels placed side-to-side, regardless of which siding panel overlaps the other.

Because there are overhangs on both sides of the composite siding panel of FIGS. 6-9, this embodiment is called a bi-directional composite siding panel. When the siding member overhangs only one side of the backing member, such an embodiment is considered a uni-directional composite siding panel.

Again, dimpling is a visual defect. FIG. 1 is a picture of conventional composite siding panels that have been installed on the exterior wall of a building. These panels are flat, and dimples are circled. These dimples are similar in appearance to dents that might result from hitting the panel with a hammer, but it should be emphasized that the panels themselves have no such structural defect. In addition, these dimples are visible only from certain angles in bright sunlight.

It is believed that the appearance of dimples may be due to the overlap zone of adjacent composite panels. Referring back to FIG. 9, in the overlap zone 308, the siding overhang of panel 306 is pushed between the backing member and the siding member of panel 305. This may cause some flexion in the siding member of panel 305 that results in the appearance of dimples from certain angles. In the composite siding panels of the present disclosure, the adhesive pattern is changed so that the flexion is spread out over a greater linear distance, such that dimpling is reduced or prevented.

Figure 2A:
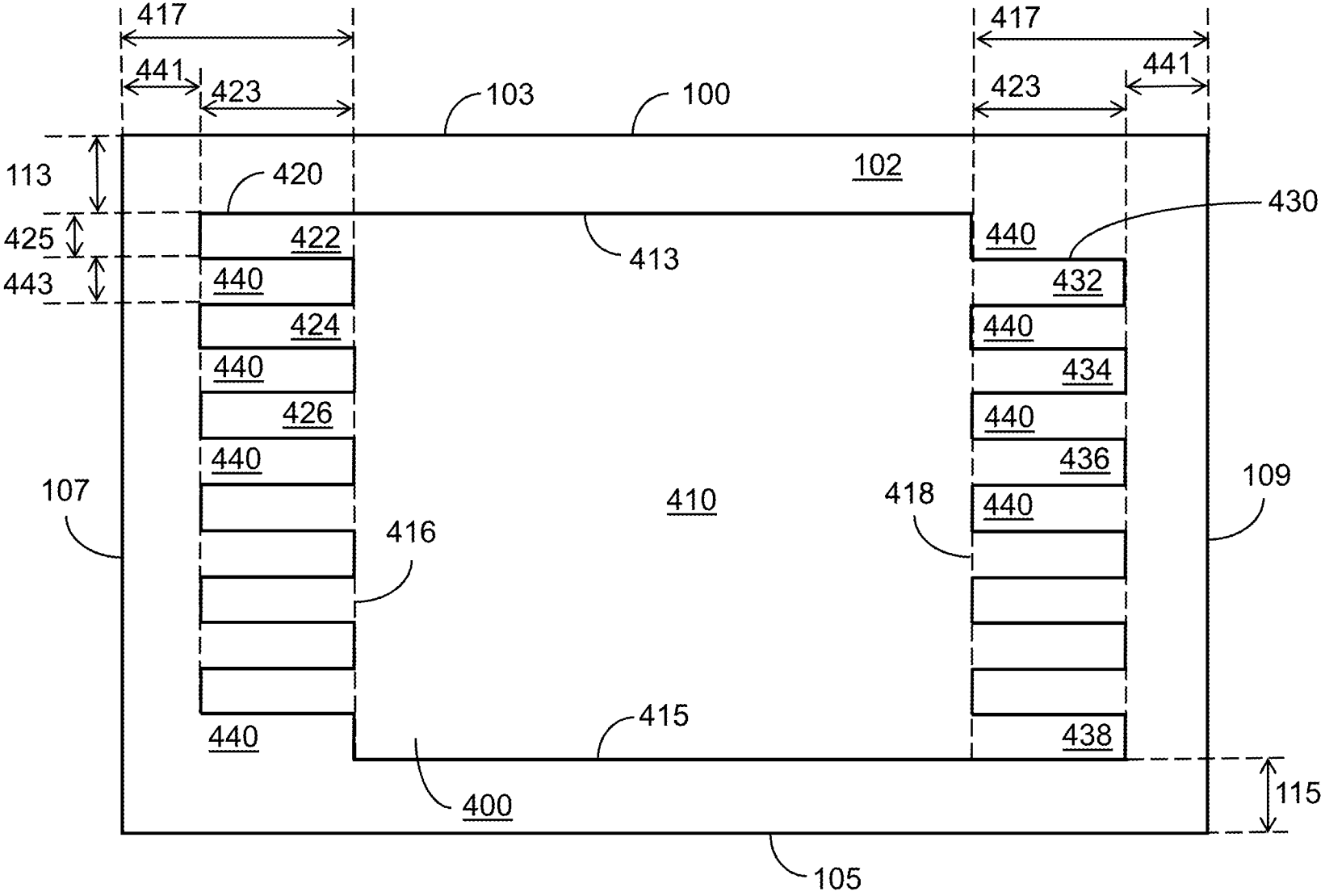
FIG. 2A is a schematic front view of one embodiment of a composite siding panel of the present disclosure, showing an adhesive layer disposed on a backing member. The adhesive layer has a sawtooth pattern formed from adhesive fingers on each side of a central area. The fingers on one side are staggered from the fingers on the other side.

FIG. 2A is a front view of a backing member 100 and an adhesive layer 400 that is believed to reduce dimpling according to the present disclosure. In FIG. 8, the adhesive layer 315 is in the shape of a rectangle, with four straight edges. In FIG. 2A, however, the sides of the adhesive layer are formed from sets of spaced-apart fingers that extend from each side edge, resulting in a staggered or sawtooth pattern.

Starting first with the backing member, the backing member 100 has a rectangular shape. The backing member has a front face 102 and a rear face (not visible) that are located opposite each other. The front face of the backing member also has a top edge 103, a bottom edge 105, a first side edge 107, and a second side edge 109 that is spaced apart or away from the first side edge 107.

The adhesive layer 400 includes a central area 410 that has a rectangular shape. The central area 410 includes a top edge 413, a bottom edge 415, a first side edge 416, and a second side edge 418 that is spaced apart or away from the first side edge 416.

The top edge 413 of the central area may also be considered the top edge of the adhesive layer. The bottom edge 415 of the central area may also be considered the bottom edge of the adhesive layer. The top edge 413 of the adhesive layer is spaced apart from the top edge 103 of the backing member by a distance 113, which may range from 0.0 inches (i.e. no spacing at all) to 4 inches. The bottom edge 415 of the adhesive layer is spaced apart from the bottom edge 105 of the backing member by a distance 115, which may range from 0.0 inches (i.e. no spacing at all) to 0.75 inches.

The adhesive layer 400 also includes a plurality of first side fingers 420, which extend from the first side edge 416 of the central area. The adhesive layer 400 also includes a plurality of second side fingers 430, which extend from the second side edge 418 of the central area. These two pluralities of fingers are also referred to herein as two different sets of fingers. Each set or plurality of fingers contains at least two fingers.

Generally, each finger 420, 430 extending from the first side edge and the second side edge has the same dimensions, and thus the dimensions are described with reference to a first side finger only. However, this is not required. Each finger 420, 430 has a length 423 (measured in the direction between the side edges of the backing member) and a height 425 (measured in the direction between the top end and the bottom edge of the backing member). The length 423 is, in embodiments, at least 1 inch, or from 1 inch to 3 inches. In particular embodiments, the length of each finger is at least 4 inches, and in more specific embodiments can be from 1 inch to 4.5 inches, or from 4 inches to 4.5 inches. The height 425 of each finger can be at least 1 inch, or 2 inches or less, or from 1 inch to 2 inches. It is noted that the fingers are illustrated here as having a rectangular shape. However, it is contemplated that other shapes could potentially be used, such as circular, triangular, elliptical, etc. In addition, the adhesive is generally continuous for the entire length of the finger.

The first side edge 416 and the second side edge 418 of the central area of the adhesive layer are set back from the first side edge 107 and the second side edge 109 of the backing member. This setback is indicated with reference numeral 417. In embodiments, the setback 417 is a distance of at least 5 inches. In more particular embodiments, the setback 417 has a distance of 5 inches to 8 inches, or 5 inches to 6 inches.

Each finger 420, 430 extends laterally from the side edges of the central area 410. Put another way, the first side fingers 420 and the second side fingers 430 are also set back from the first side edge 107 and the second side edge 109 of the backing member. This setback is indicated with reference numeral 441. In embodiments, the setback 441 is a distance of at least 3.0 inches, including from 3.0 inches to 4.0 inches. In more particular embodiments, the setback 441 has a distance of 3.5 inches to 4.0 inches.

In addition, the fingers 420, 430 are spaced vertically apart from each other on their respective sides. The intervals are indicated with reference numeral 440. The height 443 of each interval is a non-zero value, and is generally the same height as finger height 425. In particular embodiments, the height of each interval is a minimum of 0.25 inches. In particular embodiments, the intervals between fingers are regular intervals.

In FIG. 2A, the first side fingers 420 and the second side fingers 430 are staggered relative to each other. Put another way, the first side fingers 420 and the second side fingers 430 extend from the central area at different heights relative to the top edge or the bottom edge of the central area of the adhesive layer. Here, first side finger 422 extends from the first side edge 416 at the same height as top edge 413, followed by an interval 440, then first side finger 424, then an interval 440, then first side finger 426, etc., ending with an interval 440 at the same height as bottom edge 415. In contrast, on the second side edge 418, there is an interval 440 at the same height as top edge 413, followed by second side finger 432, then an interval 440, then second side finger 434, then an interval 440, then second side finger 436, etc. This ends with a second side finger 438 extending from the second side edge at the same height as bottom edge 415. Put another way, if there is a finger extending from one side edge of the central area, there is a corresponding interval on the other side edge of the central area at the same height.

Figure 3A:
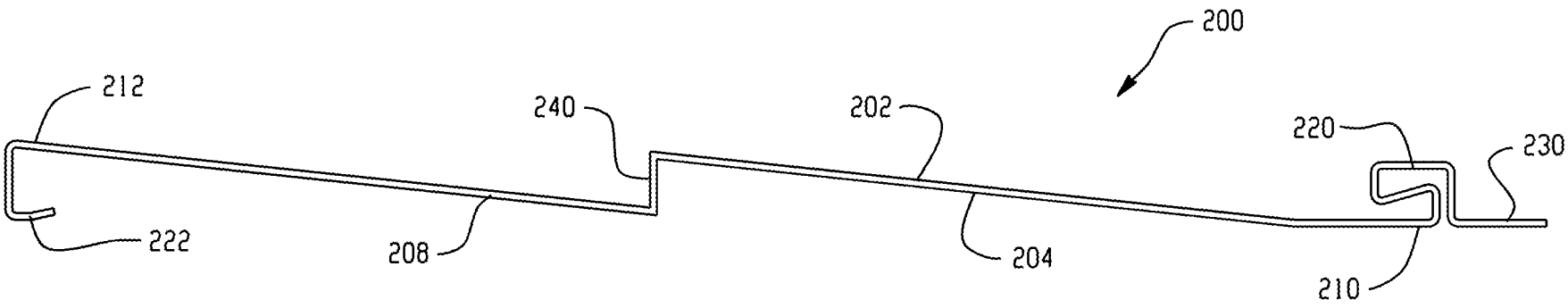
FIG. 3A is a side view of a siding member according to the present disclosure. The siding member includes contours that are complementary to the contours of the backing member.

FIG. 3A provides a side view of an exemplary siding member 200 used in embodiments of the present disclosure. The siding member 200 has a front face 202 and a rear face 204, which are located opposite each other. The siding member 200 also includes longitudinally-extending first and second side edges (one side edge 208 is visible here). The first and second side edges of the siding member 200 generally extend parallel to one another. The siding member 200 includes a locking flange 220 proximate a top end 210 of the siding member 200. The siding member 200 also includes a locking lip 222 proximate a bottom end 212 of the siding member 200. The locking flange 220 is complementary in shape to the locking lip 222. In this way, the locking flange 220 can operably engage or cooperate with the locking lip 222 of another siding member stacked above it.

Figure 2B:
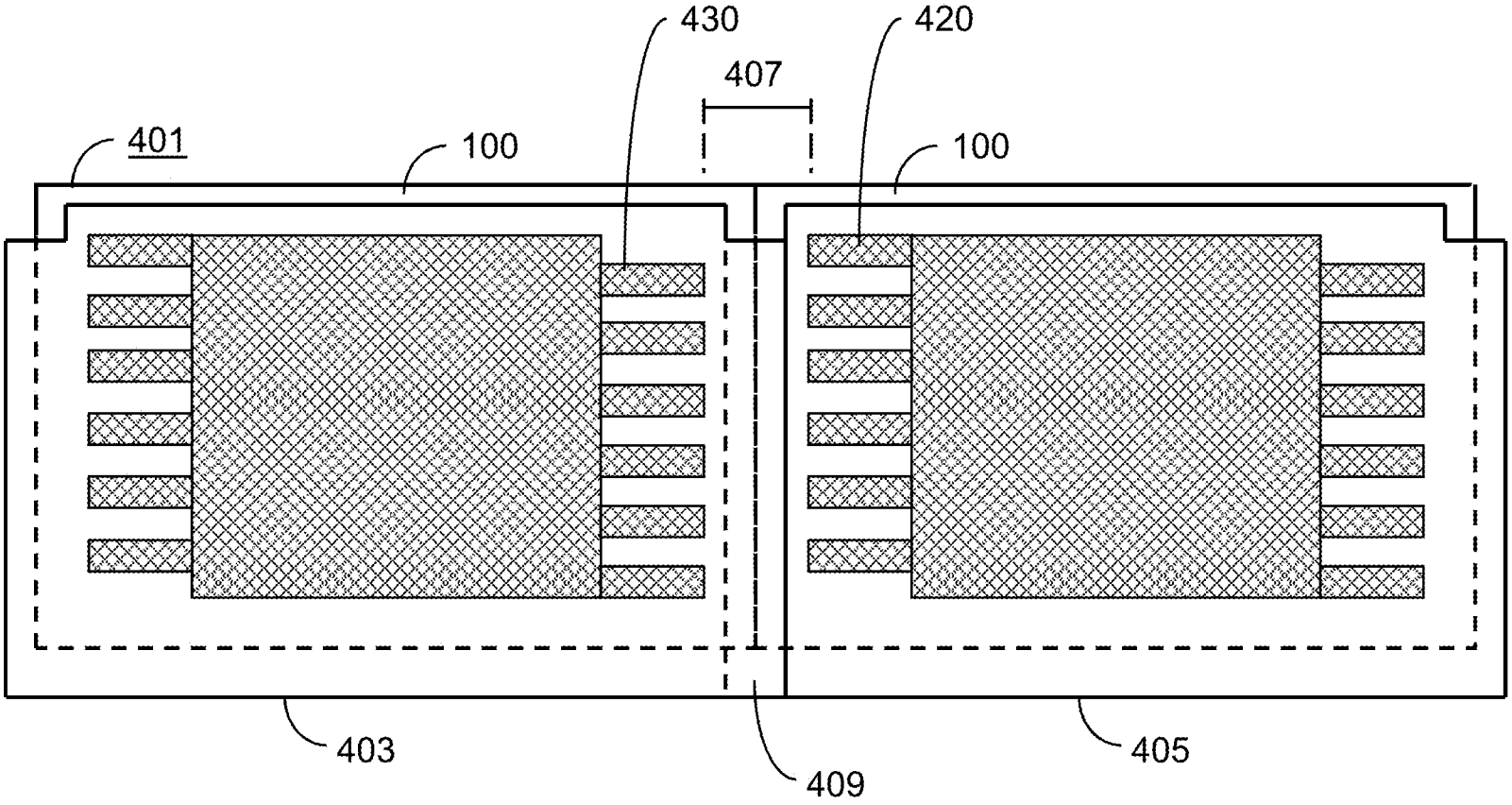
FIG. 2B is a front view of a siding assembly comprising two of the composite siding panels of FIG. 2A placed side-to-side adjacent one another with the backing members abutting one another (i.e., foam on foam contact). Solid lines indicate the perimeters of the siding members, and the outer dashed lines indicate the perimeter of the portions of the backing members behind the siding members. The shaded areas indicate the location of adhesive on the front faces of the backing members.

FIG. 2B illustrates a siding assembly 401 comprising two composite siding panels 403, 405. Here, the siding panels are illustrated with bi-directional siding members, similar to FIG. 9. The composite siding panels 403, 405 are placed side-by-side adjacent one another with the backing members 100 abutting one another (i.e., foam on foam contact). The fingers 420, 430 are commonly set back 3.5 inches from each side of the backing member. Thus, there is commonly an adhesive gap 407 (i.e., a zone in which no adhesive is present) between the backing members of the adjacent siding panels, which for example can be 7.0 inches (depending on the setback 441 of FIG. 2A). The siding panel overhangs overlap each other in the zone with reference numeral 409.

The siding member 200 can have any desired shape or size, as will be appreciated by those skilled in the art, and usually have a length of several feet. In this regard, the siding member 200 can have any suitable configuration, profile, or contour suitable for a given application. The siding member 200 can be formed from any suitable material, namely a material suitable as an aesthetic outer surface of a building or the like. In particular embodiments, the siding member 200 can be formed of vinyl, polypropylene, aluminum, steel, fiberglass, engineered wood, or fiber cement. It is contemplated that the siding member 200 could have some other polymeric veneer profile. It is contemplated that the siding member 200 will be composed of a suitable polymeric material, with vinyl materials being particularly suitable. The siding member 200 can have any suitable thickness, but is usually less than 0.1 inches. Usually, the structural strength of the backing member 100 is such that the need for structural strength and integrity of the siding member 200 is minimized. It is contemplated that the siding member 200 can be composed of any suitable sheet or film stock material. Materials of choice typically will be materials resistant to extremes in the external environment over the life of the siding system. Non-limiting examples of environmental challenges include extremes in temperature, prolonged exposure to ultraviolet light, and/or certain levels of impact and vibrational challenges due to wind and the like. In this regard, it is contemplated that the siding member 200 will be composed of any suitable polymeric, metal, plastic (e.g., fiber-reinforced plastic), composite wood, or cementitious material capable of providing suitable environmental resistance and durability.

Figure 3B:
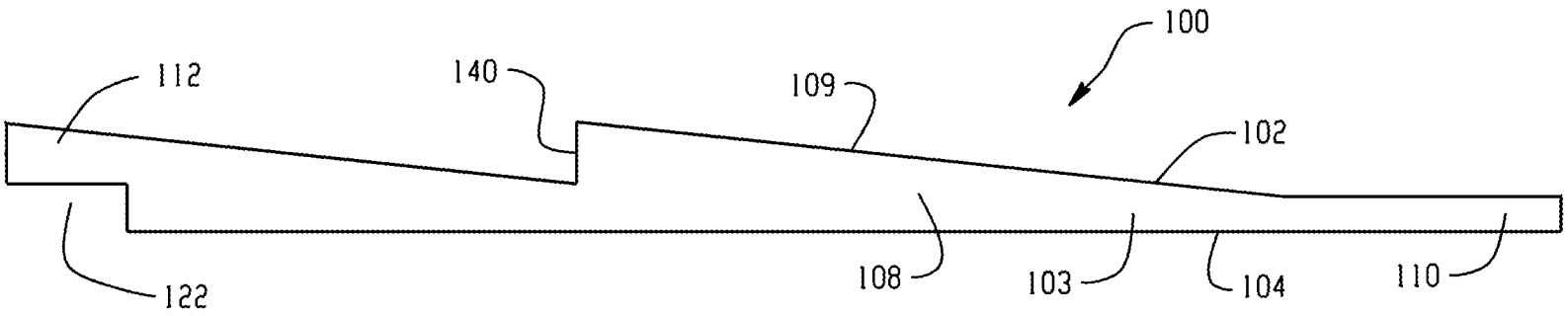
FIG. 3B is a side view of a backing member according to the present disclosure. The backing member includes contours that are complementary to the contours of the siding member. These figures also show additional features of the composite siding panel.

FIG. 3B is a side view of an exemplary backing member 100 according to the present disclosure. The backing member 100 has a front face 102 and a rear face 104, located opposite each other. The rear face 104 is planar, such that it is mountable on another planar surface, such as an exterior wall of a building. The backing member 100 includes longitudinally-extending first and second side faces (only second side face 108 is visible). Front side edges are present at the intersection of the front face 102 with each side face. As is visible here, second side edge 109 is present at the intersection of the front face 102 with the second side face 108. The first and second side faces of the backing member 100 are generally planar and extend parallel to one another.

The backing member 200 of this exemplary embodiment includes a laterally-extending relief channel 122 defined in the rear face 104 and located proximate a bottom end 112 of the backing member 100. The relief channel 122 generally runs from the first side face to the second side face of the backing member 100, and is configured to be complementary to the top end 110 of a longitudinally adjacent backing member located below it, or in other words so the top end fits in the relief channel 122. In this embodiment, they are shaped in the form of a tongue 110 and a groove 122, which are used to join adjacent panels together vertically. The backing member 100 also has a contour 140 defined therein.

Referring now to both FIG. 3A and FIG. 3B, the siding member 200 has one or more complementary-shaped contours 240 defined therein. In this way, the siding member 200 can be configured to be in overlying relationship with the backing member 100 and be closely attached thereto without any gap present therebetween. It is contemplated that the backing member 100 and the siding member 200 may have any suitable configuration desired or required to impart the aesthetic look desired. Put another way, the front face 102 of the backing member 100 can be angled with respect to the rear face 104 of the backing member 100. Suitable configurations are depicted in the various drawings, though other suitable configurations are possible, as will be appreciated by those skilled in the art. The degree of correspondence between the shape of the siding member 200 and the shape of the backing member 100, including any contours defined in either, can be at any degree from approximate to exact depending on various factors, including but not limited to the material type and/or thickness of the siding member 200.

The backing member 100 can be molded to any desired shape or size, as will be appreciated by those skilled in the art, and usually have a length of several feet. In particular embodiments, the backing member 100 can be composed of closed-cell expanded foam, such as a polymeric foam like expanded polystyrene (EPS) foam. In other embodiments, the backing member 100 can be formed from wire-fabricated foam.

Figure 4:
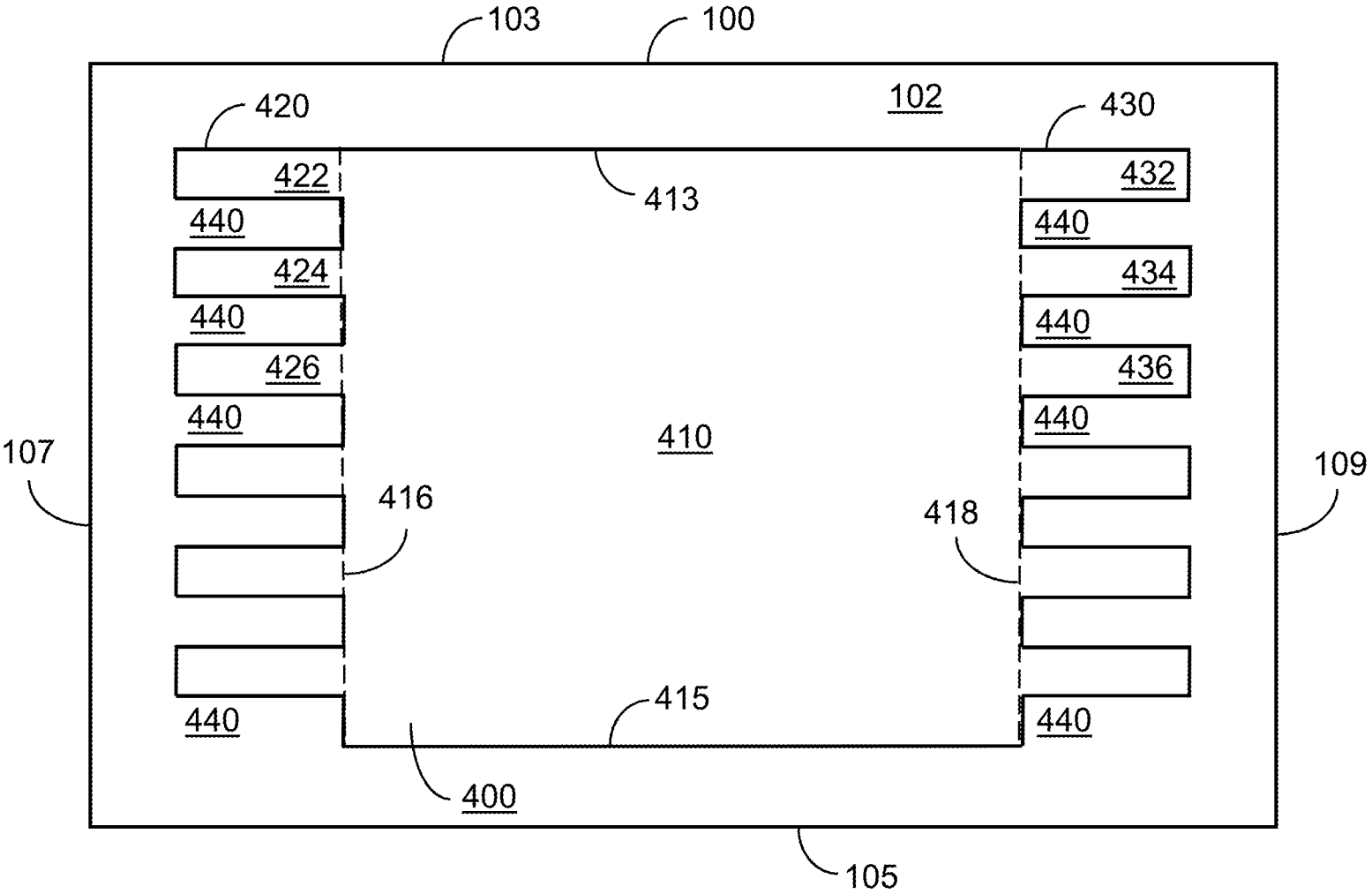
FIG. 4 is a schematic front view of one embodiment of a composite siding panel of the present disclosure, showing an adhesive layer located on a backing member. The adhesive layer has a sawtooth pattern of adhesive fingers on each side of a central area. The fingers extend from both sides at the same height.

Continuing, FIG. 4 shows another embodiment of the composite siding panel according to the present disclosure. Here, instead of the fingers 420, 430 being staggered relative to each other, they are at the same height as each other relative to the top edge or the bottom edge of the central area of the adhesive layer. For example, first side finger 422 extends from the first side edge 416 at the same height as top edge 413, followed by an interval 440, then first side finger 424, then an interval 440, then first side finger 426, etc. Similarly, second side finger 432 extends from the second side edge 416 at the same height as top edge 413, followed by an interval 440, then second side finger 434, then an interval 440, then second side finger 436, etc. Both sides have an interval 440 at the same height as bottom edge 415. Put another way, if there is a finger extending from one side edge of the central area, there is also a corresponding finger extending from the other side edge of the central area at the same height.

Figure 5:
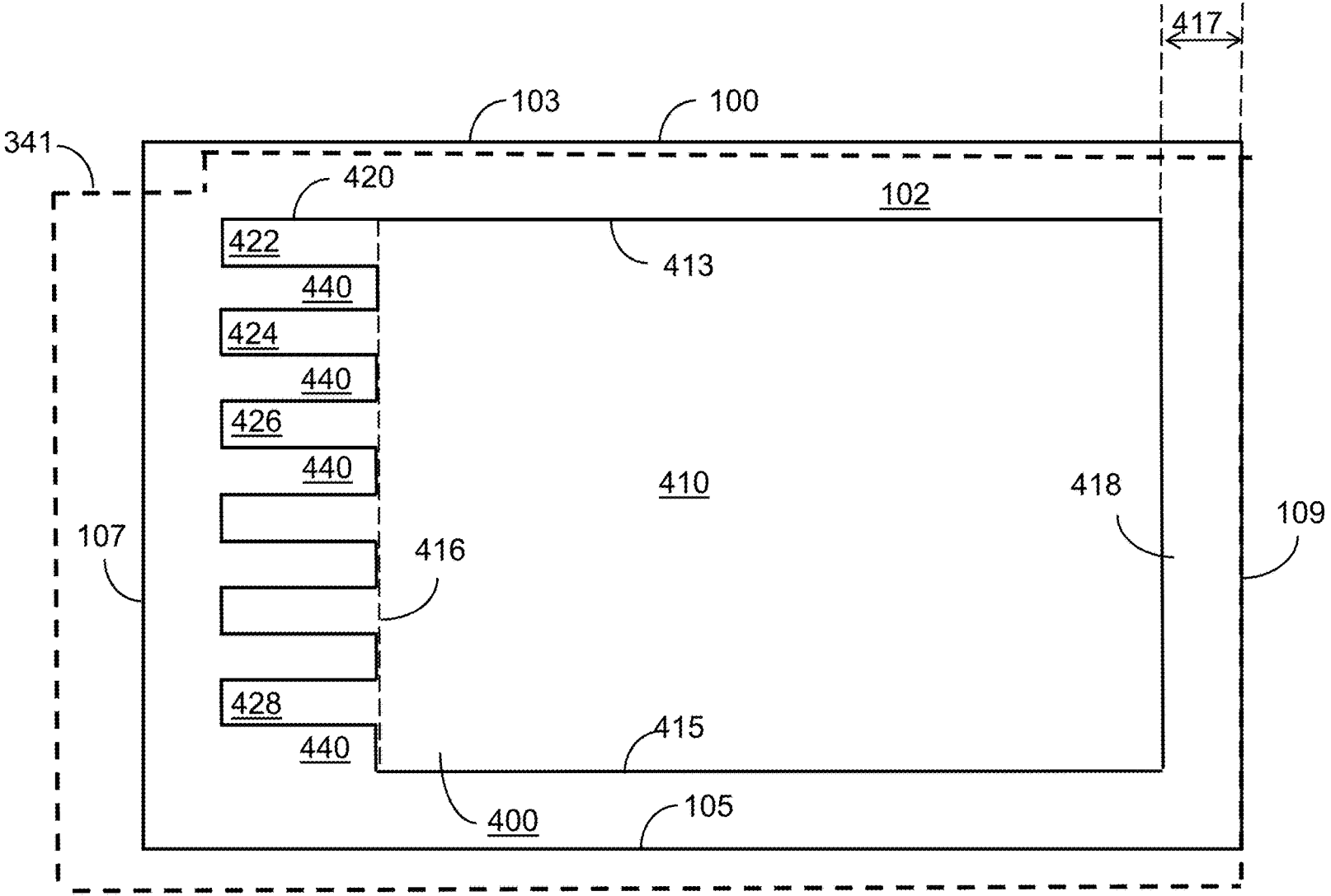
FIG. 5 is a schematic front view of one embodiment of a composite siding panel of the present disclosure, showing an adhesive layer located on a backing member. The adhesive layer has a sawtooth pattern of adhesive fingers on only one side of a central area. This may be suitable for a unidirectional composite siding panel.

The example illustrated in FIG. 2A, with fingers extending from both sides, is particularly appropriate for a bi-directional composite siding panel. FIG. 5 illustrates an embodiment according to the present disclosure that can also be used for a uni-directional composite siding panel, where there is only one overhang. Here, the siding member 200 is illustrated with dashed line, with overhang 341 of the siding member illustrated on the first side edge 107 of the backing member. In this case, fingers only need to extend from the side of the adhesive central area 410 that is on the same side as the side from which the siding member overhang is located. Here, fingers 420 are present extending from first side edge 416. The second side edge 418 of the central area 410 now has a setback 417 which can range from 0.0 inches up to 3.5 inches (this value is similar to that of a conventional composite siding panel), and in particular embodiments is from 0.0 inches to 0.5 inches.

The presence of the fingers of the adhesive layer reduces or prevents dimpling. In this regard, referring to FIG. 8, the siding member 320 is typically secured to the backing member 310 via adhesive layer 315, and there is an adhesive setback from the side edges of the backing member (reference numeral 345). When the siding overhang of an adjacent panel is fitted between the backing member and the siding member, the siding overhang forces the siding member away from the backing member. This separating force is applied only in the setback area. It is believed that stresses created by the abrupt transition from the adhesive-applied area to the setback area contribute to dimpling. The use of the adhesive fingers of the present disclosure create a transition area between the central area of the adhesive layer and the adhesive setback. This reduces or prevents those stresses caused by an abrupt transition, which reduces or prevents dimpling. Simply reducing the surface area of the adhesive layer would not work as effectively, because insufficient amounts of adhesive would increase the potential for complete separation of the siding member from the backing member, and would also increase the likelihood of "oil-canning", which is a perceived waviness in the flat areas of the siding panel and which is prevented by applying adhesive over a greater surface area.

The adhesive layer of the present disclosure is generally applied to the front face of the backing member. In particularly desired embodiments, the adhesive layer is formed using an adhesive that is not a pressure sensitive adhesive. Rather, the adhesive is a reactive hot melt adhesive. In particular embodiments, the adhesive is a polyurethane that has an elongation factor of 1000% or more, as measured according to ASTM D412-16. Such an adhesive is available from Henkel under the trade name Technomelt® PUR 7517 Clear, which is a polyurethane having an elongation factor of 1250%. In contrast, prior adhesives had an elongation factor of at most 600%. Technomelt® PUR 7517 Clear also has a viscosity of 10,000 centipoise (cps) at 275° F.; a tensile strength of 1100 psi measured according to ASTM D412-16; and a 100% modulus of 750 psi measured according to ASTM D412-16. Technomelt® PUR 7517 Clear contains 60 wt % to 100 wt % of an isocyanate terminated urethane polymer; 1 wt % to 5 wt % of methylene bis(phenylisocyanate); and 0.1 wt % to 1 wt % of methylene bisphenyl isocyanate. Another such adhesive is available from Henkel under the trade name Technomelt® PUR 7117, which has the same properties as Technomelt® PUR 7517 and is believed to contain the same ingredients (i.e. an isocyanate terminated urethane polymer, methylene bis(phenylisocyanate, and methylene bisphenyl isocyanate).

The adhesive layer can be applied by any suitable method. The adhesive layer joins the rear face of the siding member to the front face of the backing member. The central area of the adhesive layer can be continuous or discontinuous, while the fingers are continuous. Again, it is noted that the margin of error for applying adhesive to the desired locations is ±¼ inch. Spray deposition can be utilized as well as methods such as extrusion, roller coating, curtain coating, and the like. In certain applications, it is contemplated that the adhesive can be applied by a suitable spray applicator to provide a thin uniform adhesive coating over the tough durable skin of the backing member. The backing member may have a smooth surface finish that fits snuggly with the siding member, thereby increasing adhesive mileage and reducing adhesive quantities, with the resulting bond being stronger.

Some other less suitable materials for the adhesive may include continuously flexible non-latex adhesives, such as thermoplastic PSAs, UV curable adhesives and hot melt adhesives, such as polyamines and urethanes, glue, thermosetting or thermoplastic adhesives, or pressure sensitive adhesives. Non-limiting examples of suitable spray thermoplastic adhesive coating materials include those commercially available from National Starch under the trade name DUROTAK, or available from Henkel under the trade name Technomelt® PUR 9011.

Because they are to be attached to each other, the rear face 204 of the siding member 200 is generally shaped complementary to the front face 102 of the backing member 100, as previously explained. It is contemplated that the backing member 100 can be shaped to have a suitable configuration complementary to the configuration of the siding member 200. Suitable configurations are depicted in the various drawings, though other suitable configurations are possible, as will be appreciated by those skilled in the art. The degree of correspondence between the shape of the siding member 200 and the shape of the backing member 100, including any contours defined in either, can be at any degree from approximate to exact depending on various factors, including but not limited to the material type and/or thickness of the siding member 200.

The siding member can be attached to the backing member in a wide variety of fashions. It is contemplated that connection can occur at any time between manufacture and installation such that the siding member and the backing member are joined to one another in the installed or "in use" configuration.

The following examples are presented to illustrate the composite panels described herein, and are not intended to limit the present disclosure.

EXAMPLES

Example 1

Multiple composite siding panels were made with various setbacks for the central area and the fingers (relative to the side edges of the backing member). As a control, a composite siding panel with an adhesive setback of 2.5 inches (i.e. no fingers) was used. The composite siding panels were then exposed to sunlight over the course of a day, and dimpling was measured. Dimpling was measured visually, and was a yes/no measurement (either it occurred or it did not). The adhesive used to join the backing member to the siding member was PURHM QR9011. The results are provided in the table below:

TABLE 1

| Results | | | |
|---|---|---|---|
| Example | Central area setback (in) | Finger setback (in) | Dimpling |
| Control | 2.5 | -N/A- | YES |
| A | 3.5 | 1.5 | YES |
| B | 8.5 | 1.5 | YES |
| C | 10 | 3.5 | YES |
| D | 5.5 | 3.5 | NO |
| E | 10 | 8 | YES |

Example 2

Two composite siding panels were made using different adhesives, then exposed to sunlight over the course of a day, and dimpling was measured. The adhesives used to join the backing member to the siding member were Technomelt® PUR 9011 (elongation factor below 600%) and Technomelt® PUR 7517 Clear (elongation factor of 1250%). The results are provided in the table below:

TABLE 2

| Example | Adhesive | Dimpling |
|---|---|---|
| F | Technomelt ® PUR 9011 | YES |
| G | Technomelt ® PUR 7517 Clear | NO |

The present disclosure has been described with reference to exemplary embodiments. Obviously, modifications and alterations will occur to others upon reading and understanding the preceding detailed description. It is intended that the present disclosure be construed as including all such modifications and alterations insofar as they come within the scope of the appended claims or the equivalents thereof.

The invention claimed is:

1. A composite siding panel, comprising:

a backing member having a front face, a rear face opposite the front face, a first side edge, and a second side edge opposite the first side edge;

a siding member having a front face, a rear face opposite the front face, a first side edge, and a second side edge opposite the first side edge; and an adhesive layer that joins the rear face of the siding member to the front face of the backing member, wherein the adhesive layer comprises a central area having a first side edge and a second side edge, and a set of spaced-apart first fingers extending from the first side edge of the central area.

2. The composite siding panel of claim 1, further comprising a set of spaced-apart second fingers extending from the second side edge of the central area.

3. The composite siding panel of claim 2, wherein the first fingers and the second fingers are staggered relative to each other.

4. The composite siding panel of claim 2, wherein the first fingers and the second fingers are at the same height.

5. The composite siding panel of claim 2, the first fingers are spaced apart from each other at regular intervals, and the second fingers are spaced apart from each other at regular intervals.

6. The composite siding panel of claim 2, wherein the first side edge and the second side edge of the central area of the adhesive layer are set back from the first side edge and the second side edge of the backing member by a distance of 5 inches to 8 inches.

7. The composite siding panel of claim 2, wherein the first fingers and the second fingers are set back from the first side edge and the second side edge of the backing member by a distance of at least 3.0 inches.

8. The composite siding panel of claim 2, wherein the first fingers and the second fingers each have a length of 1 inch to 3 inches.

9. The composite siding panel of claim 2, wherein the first fingers and the second fingers each have a height of 1 inch to 2 inches.

10. The composite siding panel of claim 1, wherein the adhesive layer is made of a polyurethane having an elongation factor of 1000% or greater.

11. The composite siding panel of claim 1, wherein the first side edge of the central area of the adhesive layer is set back from the first side edge of the backing member by a distance of at least 5 inches; and the second side edge of the central area of the adhesive layer is set back from the second side edge of the backing member by a distance of 0.0 inches to 0.5 inches.

12. The composite siding panel of claim 11, wherein the first fingers are set back from the first side edge of the backing member by a distance of at least 3.0 inches.

13. The composite siding panel of claim 11, wherein the first fingers each have a length of 1 inch to 3 inches.

* * * * *